US005207010A

United States Patent [19]

Grossman

[11] Patent Number: 5,207,010

[45] Date of Patent: May 4, 1993

[54] PORTABLE AUTOMOBILE SNOW PLOW

[76] Inventor: David D. Grossman, 100 Prospect Dr., Chappaqua, N.Y. 10514

[21] Appl. No.: 898,412

[22] Filed: Jun. 15, 1992

[51] Int. Cl.[5] ..... E01H 5/00

[52] U.S. Cl. ..... 37/231; 37/196; 37/233; 37/272; 229/23 R; 229/103; 229/120.01

[58] Field of Search ..... 37/196, 197, 231, 266, 37/272, 273, 233; 229/23 R, 103, 120.01

[56] References Cited

U.S. PATENT DOCUMENTS 2,222,437 11/1940 Lykken ..... 37/197
2,575,091 11/1951 Borgeson ..... 37/231
2,871,080 1/1959 Shelly ..... 229/120.01 X
3,113,673 12/1963 Stein ..... 229/120.01 X
4,205,776 6/1980 Rüer ..... 229/120.01 X
4,255,884 3/1981 Williams ..... 37/231 X

*Primary Examiner*—Dennis L. Taylor
*Assistant Examiner*—Arlen L. Olsen
*Attorney, Agent, or Firm*—Lilling & Lilling

[57] ABSTRACT

The invention consists of a plurality of separate pieces that may be fastened together to create a portable automobile snowplow. Each of the parts is folded in a speci7 fied fashion in order to define a particular portion of the snowplow. Then, by means of tabs and slots or other suitable fastening means, the parts may be affixed together. For simplified storage, the parts may be sized in a manner to permit them to be nested within each other.

4 Claims, 8 Drawing Sheets

PORTABLE AUTOMOBILE SNOW PLOW

FIELD OF THE INVENTION

The invention relates to snow plows for attachment to automobiles, and, in particular, to a portable, knock down snow plow that can be made from inexpensive and easily disposable materials.

DESCRIPTION OF THE PRIOR ART

There are many known methods for snow removal, including use of a manual shovel, snow blowers, snow inhalers, sweeping, application of heat or fluids, and snow plows. In most instances, snow plows are sturdy, rigid devices, generally made of metal or other strong materials. Typically, they are permanently mounted on vehicles and are operated by mechanical linkages with hydraulic or electromagnetic actuators. These devices generally cannot be easily stowed in the trunk of an automobile or easily mounted on the automobile. Further, these items are generally relatively expensive.

Therefore, it can be seen that there is a need for a snow plow which can be made from inexpensive and disposable materials, and which is lightweight and which can be easily folded or disassembled for simple storage in the trunk of an automobile.

SUMMARY OF THE INVENTION

The portable automobile snow plow of this application is made from inexpensive and disposable materials, such as cardboard or other planar materials. These materials are folded and cut to define a combination of boxes, which are affixed together to define a plow. For simple storage, the boxes can be disengaged from each other and nested within each other, to form a simple compact box which can be easily stored in the trunk of an automobile. Because of the materials used, it is inexpensive and easily disposable.

DETAILED DESCRIPTION OF THE INVENTION

Figure 1:
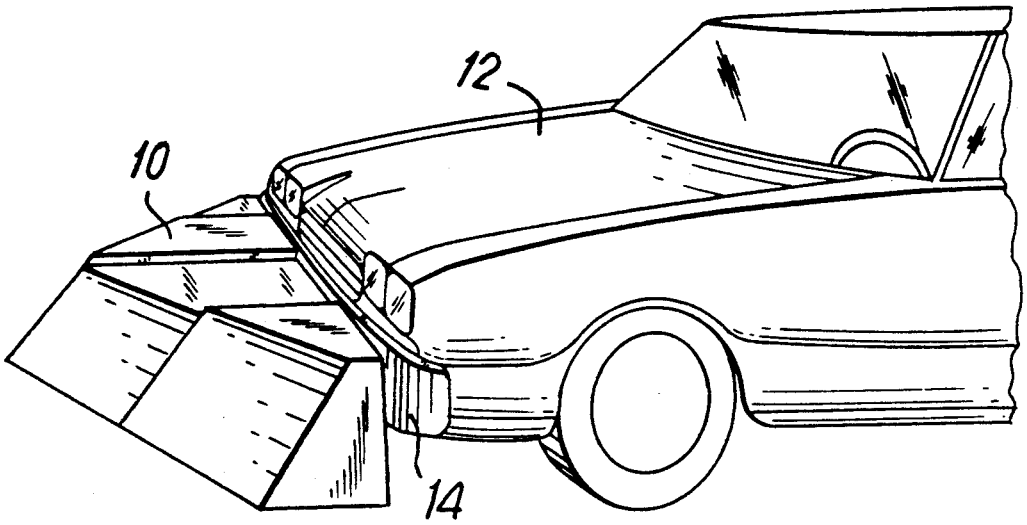
FIG. 1 is a perspective view showing the portable automobile snow plow affixed to an automobile.

The portable automobile snow plow can be made from any planar material. In the preferred embodiments, it is made from corrugated cardboard. In other embodiments, the planar material can be made of any suitable laminate. In some instances, it will be preferable for the planar material to be treated with a water resistant coating or to be made fire retardant.

The portable snow plow 10 is designed for suitable affixation to the front end 14 of an automobile 12 or other vehicle. This can be done with straps, velcro strips, screws, bolts, adhesives, or any other suitable material. In some embodiments, it may be desirable to not even connect the portable snowplow to the automobile. In such a situation, the automobile could simply push the snowplow in the desired direction.

The snow plow 10 may typically be made of nine separate parts. In the preferred embodiment, three sheets of planar material may be used for the manufacture of these nine parts.

A first sheet of planar material would be used to define and create the first part 16 and the third part 20, a second sheet would be used to create and manufacture the second part 18 and the fourth part 22, and a third sheet of material may be used to create and manufacture the fifth part 24, the sixth part 26, the seventh part 28, the eighth part 30 and the ninth part 32. It is of course possible to make each part out of a single sheet of planar material.

Figure 4:
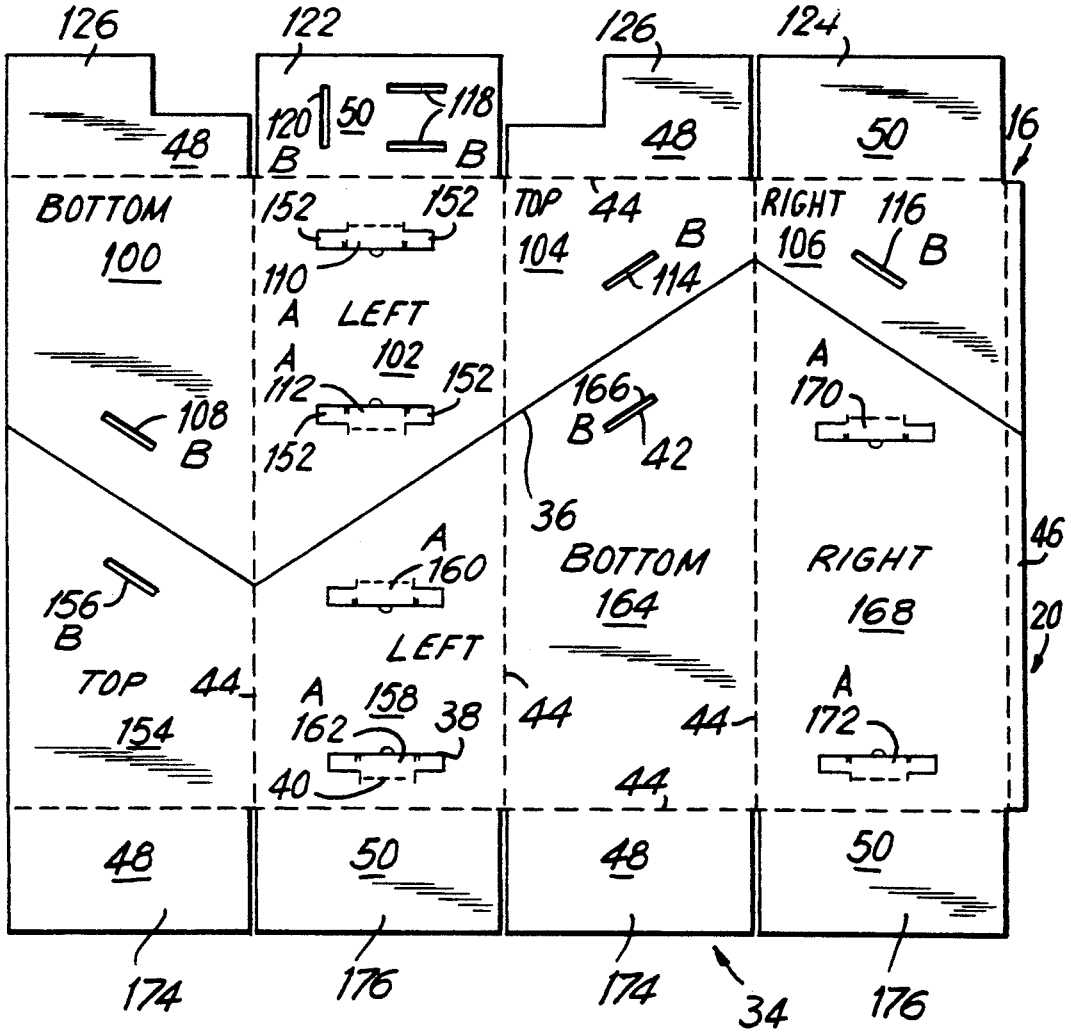
FIG. 4 is a plan view of the material out of which the first and third pieces are made.

FIG. 4 shows a single sheet of planar material 34 that is used to create the first part 16 and the third part 20. Zigzag line 36 represents a line along which the sheet material 34 is cut to define the first and third part 16 and 20. Solid lines 38 represent lines that should be cut out to define tabs A, and dotted lines 40 represent lines for folding, so as to define the tabs A. Solid lines 42 define cut lines for defining slots B. Dotted lines 44 represent fold lines for folding the first and third members 16 and 20 to define boxlike members. As shown, a narrow flap portion 46 is defined at one end of the sheet material 34, so that the boxlike members 16 and 20 can be defined and securely held together. Typically, an adhesive material would be applied to the surface of the narrow flap 46, for affixation of the narrow flap member 46 to the opposite panel of the part for defining a boxlike member when the sheet material is folded along the fold lines 44.

After the boxlike members are thus defined, the inner flaps 48 would be folded over and the outer flaps 50 would be folded on top of the inner flaps in order to define a closed end of the boxlike members. Suitable adhesives may be used to hold the flaps in position.

In assembling the boxlike members, care should be taken to make certain that the slots B are not covered and that the tabs A are not separated from the boxlike members.

Figure 5:
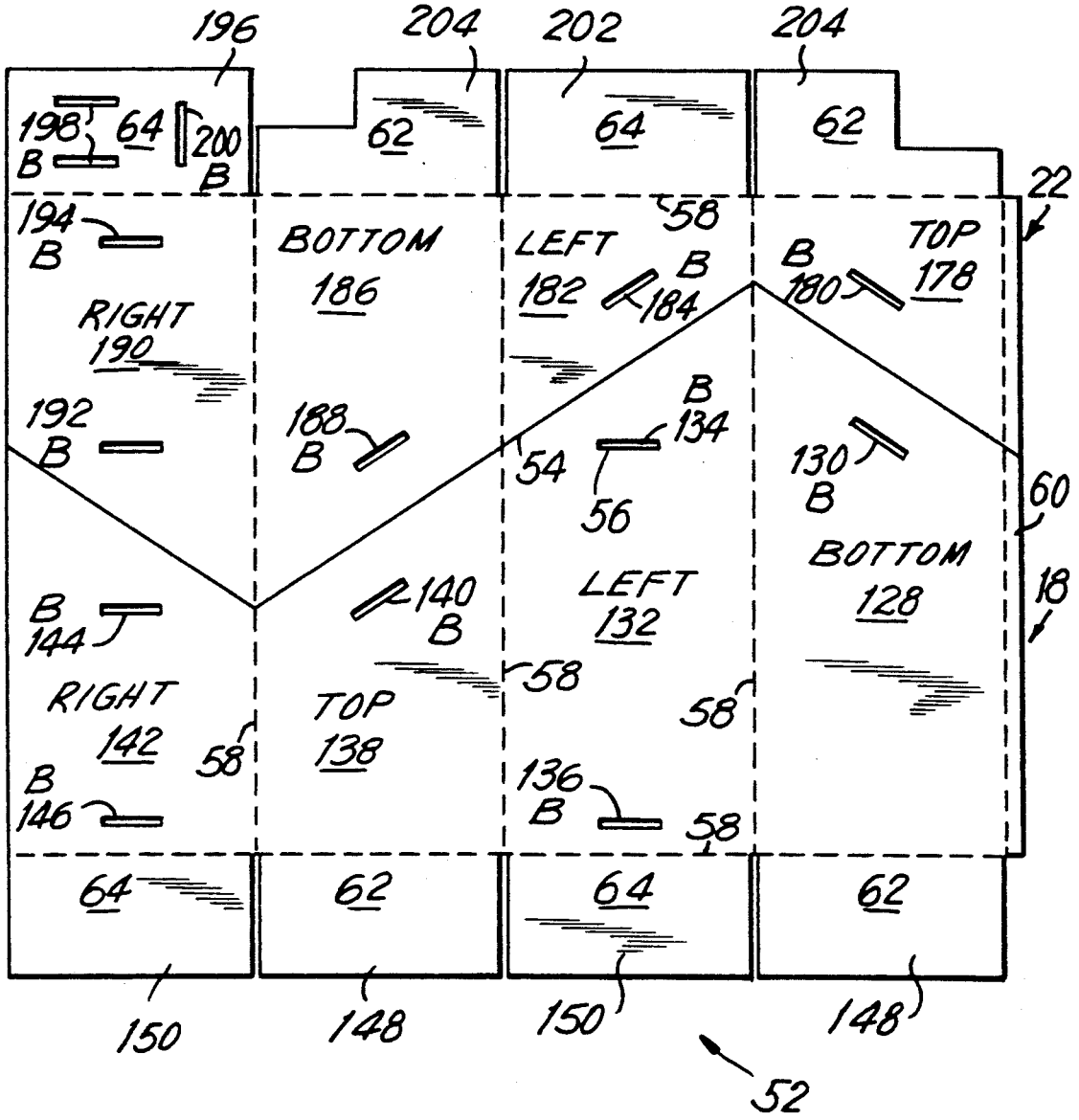
FIG. 5 is a plan view of the material out of which the second and fourth pieces are made.

In similar fashion, the second and fourth parts 18 and 22 can be made from the sheet material 52 (see FIG. 5). A zigzag line 54 is provided for cutting out the two members, and solid lines 56 are cut to define the slots B. As mentioned above, the two box members 18 and 22 are folded along the fold lines 58 to define boxlike structures and an adhesive is applied to the narrow flap 60 to hold the assembly in a boxlike form. The inner flaps 62 and the outer flaps 64 are then folded appropriately and adhesively affixed together, thereby completing the structure of the boxlike members 18 and 22.

Figure 6:
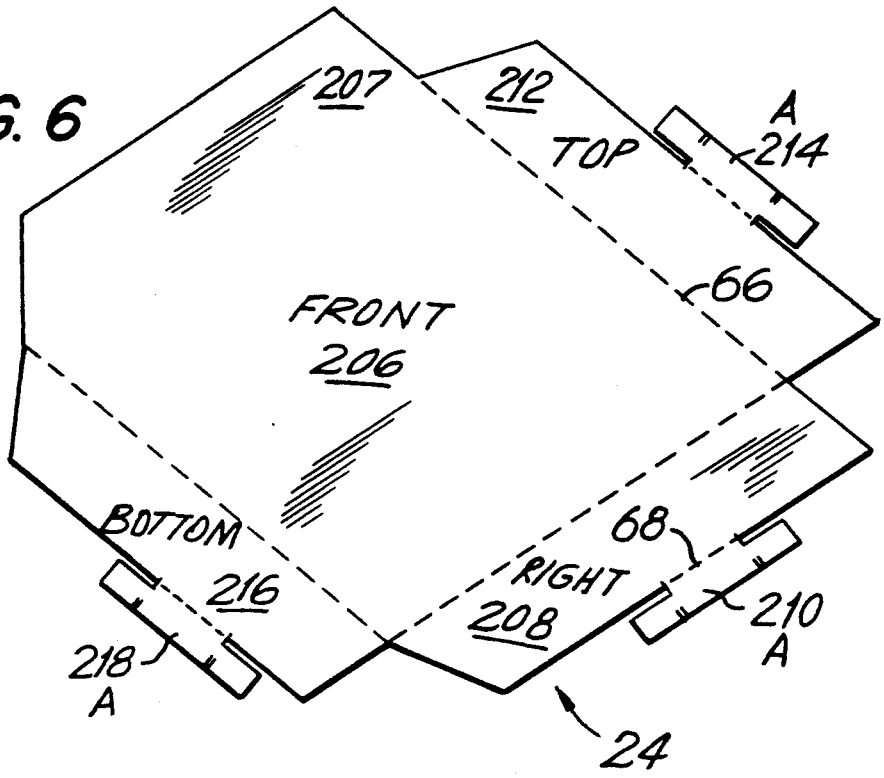
FIG. 6 is a plan view of the fifth part of the portable automobile snow plow.
Figure 7:
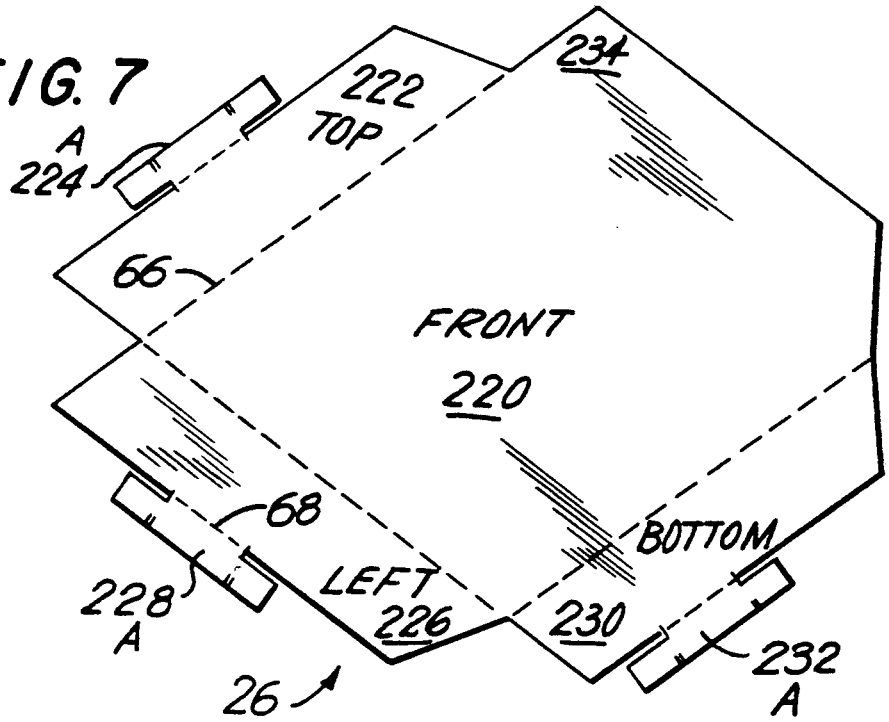
FIG. 7 is a plan view of the sixth part of the invention.

In a similar fashion, the fifth and sixth parts 24 and 26 are created (see FIGS. 6 and 7). Dashed lines 66 indicate the lines along which these parts are folded, and dashed lines 68 indicate the fold lines for forming tabs A.

Figure 8:
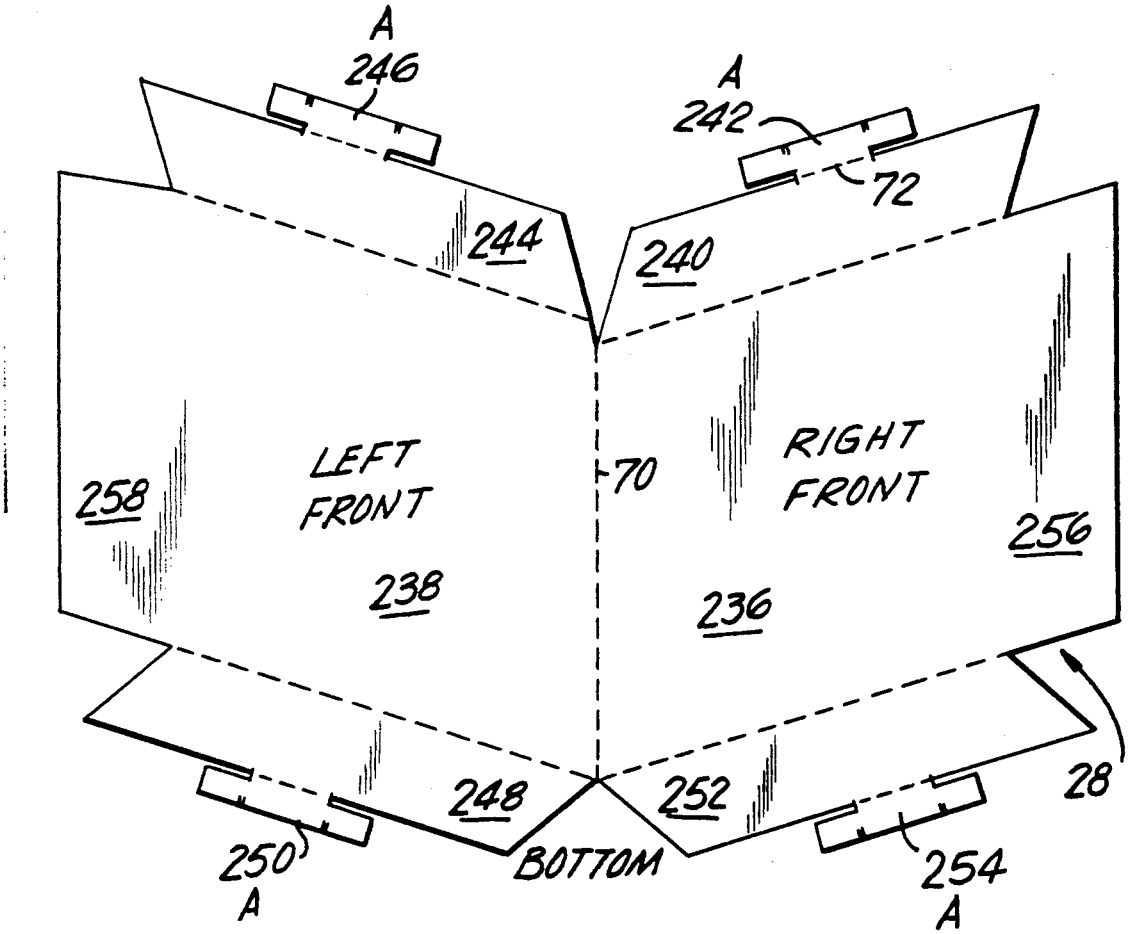
FIG. 8 is a plan view of the seventh part of the invention.
Figure 9:
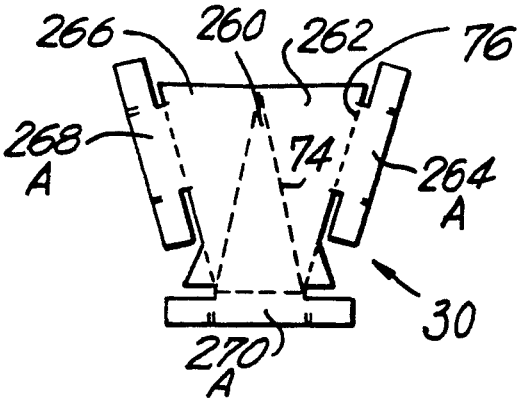
FIG. 9 is a plan view of the eighth part of the invention.
Figure 10:
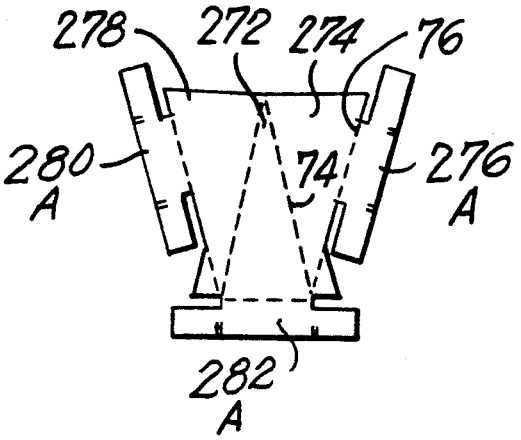
FIG. 10 is a plan view of the ninth part of the invention.

The seventh part 28 (see FIG. 8) includes dotted lines 70 for folding the part and dashed lines 72 for defining the tab A. Similarly, the eighth and ninth parts 30 and 32 (see FIGS. 9 and 10) have fold lines 74 for defining the shape of the part and fold lines 76 for defining tabs A.

As thus constructed, the first four parts 16, 18, 20 and 22 have five orthogonal closed faces and one dihedrally angled opened face. The three parts 24, 26 and 28 are used to cover the open faces of the parts 16, 18, 20 and 22. The small parts 30 and 32 are attached in the rear of the structure and provide tilt inhibition.

While reference is made to the fact that the member 16, 18, 20 and 22 can be made from planar material, in the preferred embodiment, they can be made from conventional rectangular unassembled boxes. In such situation, one of the boxes should be made slightly larger in width and height, so as to permit nesting of the other box within it. This is helpful for minimizing storage space.

To facilitate construction of the device, the planar materials can be printed with the fold lines and also with instructions. It may also be desirable to label the sides, flaps and tabs in order to facilitate construction of the portable snow plow.

Conventional cutting dies ca be used for scoring the cut and fold lines on the various sheet materials.

To facilitate assembly, it may be desirable to not cut completely along the zigzag lines 36 and 54 of the sheet materials 34 and 52. In the preferred embodiment, along each of these lines 36 and 54, there would be between three and five short interruptions of about a half inch in which there are no cuts. After the assembly of the boxlike members, the short interruptions along the zigzag lines 36 and 54 can be cut and the box is separate. By doing this, it would be easier to hold the boxlike members together for the final gluing of the flaps.

Figure 11:
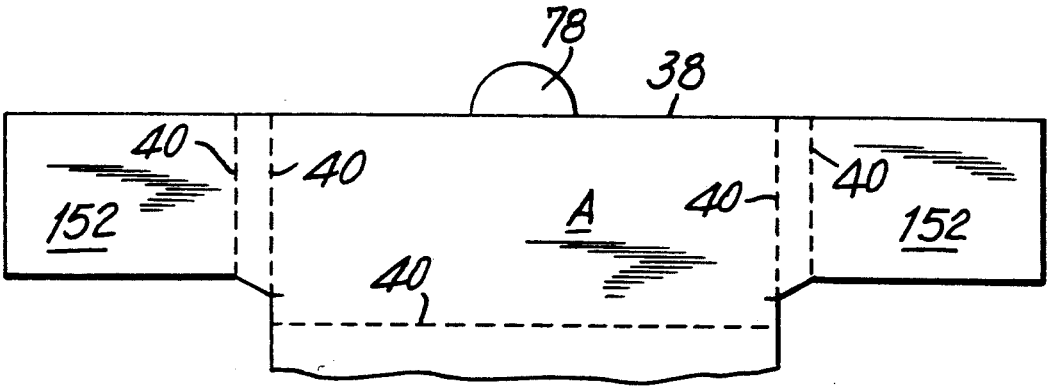
FIG. 11 is a plan view of the tab members.
Figure 12:
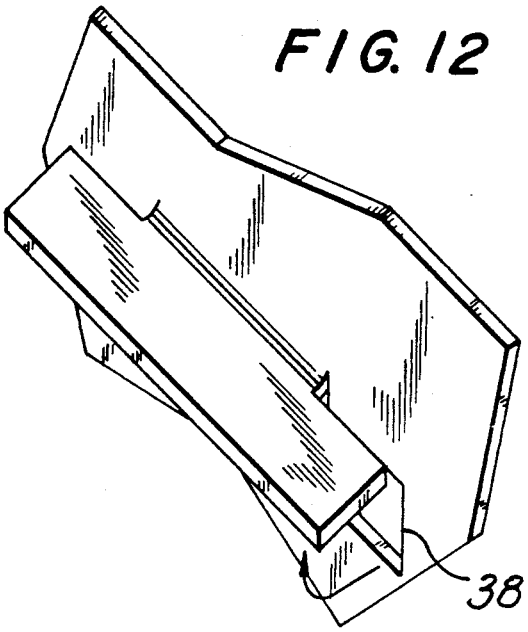
FIGS. 12–15 are oblique views showing the interconnections of the tabs and slots.
Figure 13:
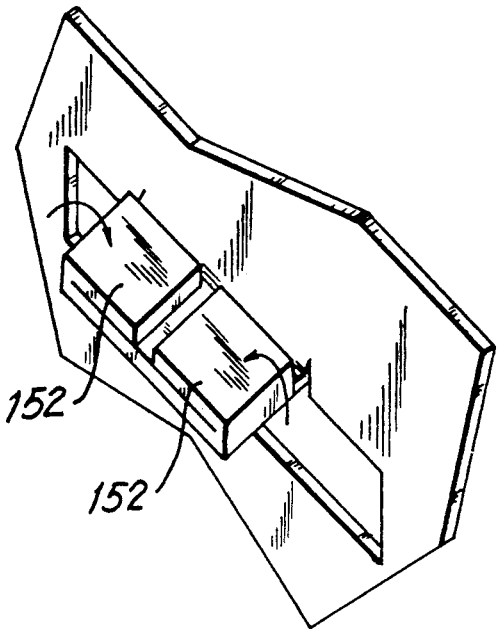
Figure 14:
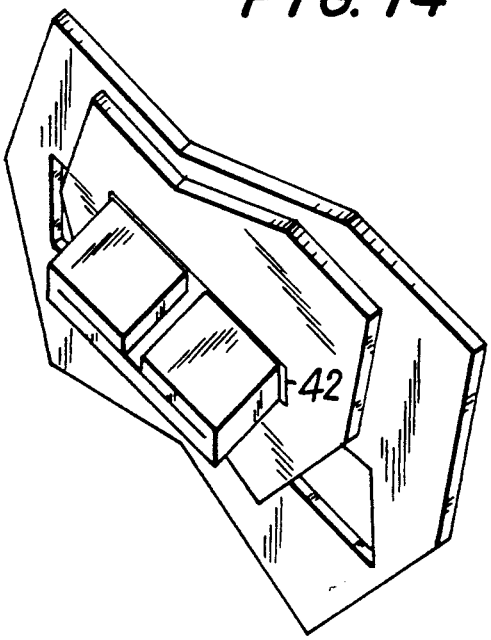
Figure 15:
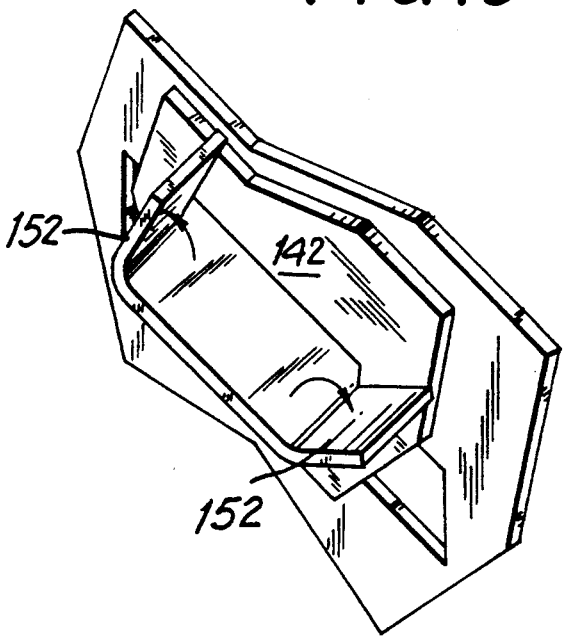

FIG. 11 shows an enlarged view of one of the tabs A. Semi-circular finger holes may be punched, as necessary, to provide finger access to the tabs.

Figure 3:
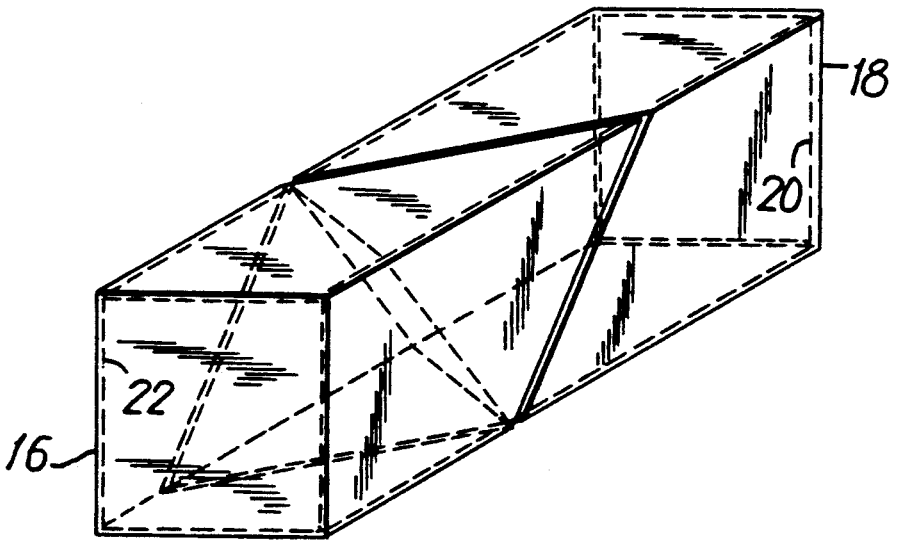
FIG. 3 is a perspective view of the portable automobile snow plow in which the component parts are separated and nested within each other for storage.

For simple storage, the fifth, sixth and seventh parts 24, 26 and 28 and the eighth and ninth parts 30 and 32 may be nested within one another and placed within the second part 18. Then the second and fourth parts 18 and 22 are nested within the first and third parts 16 and 20. This allows for simple and easy storage, as shown in FIG. 3. It provides a small compact unit which can be easily stored in the trunk of an automobile.

Figure 2:
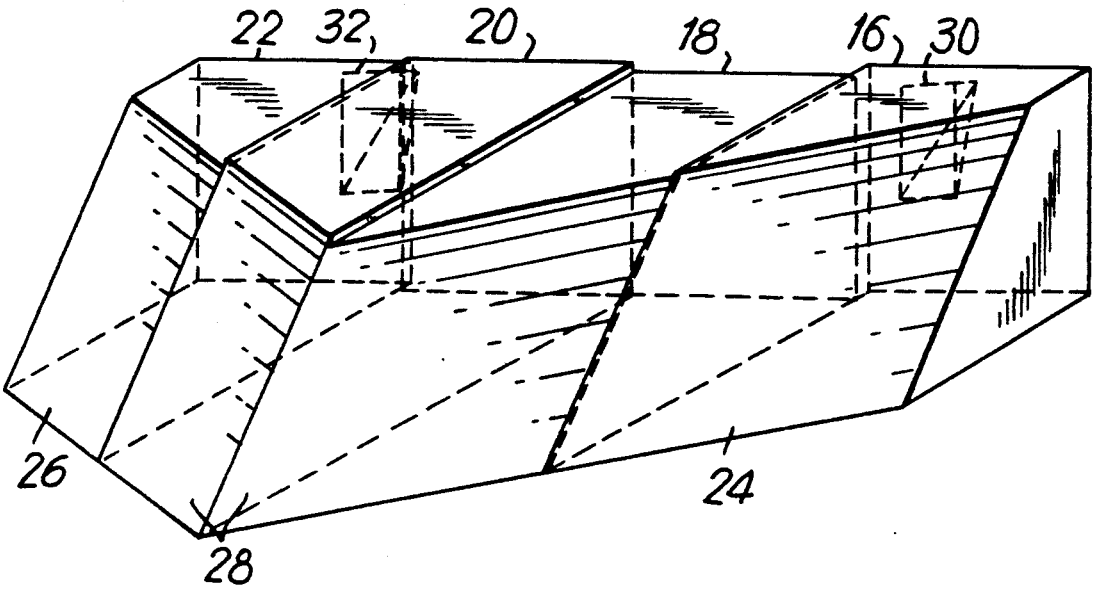
FIG. 2 is a perspective view of the portable automobile snow plow.

During assembly, the first member box 16 is attached to the second box member 18 by means of the tabs A and the corresponding slots B. Similarly, the third box member 20 is affixed to the second box member 18, and then fourth box member 22 is affixed to the third box member 20. This is accomplished as shown in FIG. 2.

The cover members 24 and 26 are attached to the first and fourth box members 16 and 22 by means of the tabs A and the slots B. Similarly, the cover member 28 is affixed to the second and third box members 18 and 20 by appropriate tabs A and slots B.

By means of the tabs A and the slots B, the small eighth and ninth parts 30 and 32 are affixed to the back of the first and fourth box members 16 and 22. As mentioned, this is to prevent tilting of the device.

Looking at the snow plow from the front, the first part 16 includes a bottom 100 with a slot 108, a left side 102 with tabs 110 and 112, a top 104 with a slot 114 and a right side 106 with a slot 116. The outer flap 122, which will be disposed in the rear of the first part 16, has two slots 118 which will be vertically oriented when the first part 16 is constructed, and a slot 120 which will be horizontally oriented. The other outer flap 124 and the inner flaps 126 of the first part 16 do not have any slots or tabs.

The second part 18 includes a bottom 128 with a slot 130, a left side 132 with vertically oriented front and rear slots 134 and 136, a top 138 with a slot 140 and a right side 142 with vertically oriented front and rear slots 144 and 146. The inner flaps 148 and the outer flaps 150 do not have any slots or tabs.

The first part of the construction of the device requires the connection of the first and second parts 16 and 18. The inner and outer tabs 112 and 110 on the left side 102 of the first part 16 are bent outward, so that they are approximately perpendicular to the surface of the left side 102. The outer wing portions 152 of the tabs 112 and 110 are folded over the central portion of the tabs. Then the tabs 112 and 110 are fit into the respective slots 144 and 146 on the right side 142 of the second part 18. The wing portions 152 are unfolded and the inner edges of these wing portions would come into contact with the inner surface of the right side 142 of the second part 18 and serve to hold the parts 16 and 18 together. (See FIGS. 12–15)

In like manner the third part 20 would be connected to the second part 18, and the fourth part 22 would be connected to the third part 20.

The third part 20 includes a top 154 with a slot 156, a left side 158 with front and rear tabs 160 and 162, a bottom 164 with a slot 166 and a right side 168 with front and rear tabs 170 and 172. The inner flaps 174 and the outer flaps 176 do not have any tabs or slots.

In order to connect the third part 20 together with the second part 18, the front and rear tabs 170 and 172 on the right side 168 of the third part 20 are inserted into the respective front and rear slots 134 and 136 on the left side 132 of the second part 18. This is done in the same manner as described heretofore in connection with the insertion of the tabs 112 and 110 into the slots 144 and 146 for connection of the first part 16 to the second part 18.

The fourth part 22 includes a top 178 with a slot 180, a left side 182 with a slot 184, a bottom 186 with a slot 188 and a right side 190 with vertically oriented front and rear slots 192 and 194. The outer flap 196 includes vertically oriented slots 198 and a horizontally oriented slot 200. The remaining outer flap 202 and the two inner flaps 204 do not have any tabs or slots.

The third and fourth parts 20 and 22 are connected by inserting the front and rear tabs 160 and 162 on the left side 158 of the third part 20 into the respective front and rear slots 192 and 194 on the right side 190 of the fourth part 22 in the manner heretofore described.

The fifth part 24 includes a substantially vertically oriented front face 206, a right side flap 208 with a tab 210, a top flap 212 with a tab 214 and a bottom flap 216 with a tab 218. The fifth part 24 is oriented so that the front surface 206 covers the open end of the first part 18 and the right flap 208 extends partially over the right side 106 of the first part 16, the top flap 212 extends partially over the top 104 of the first part and the bottom flap 216 extends partially over the bottom 100 of the first part. The extreme left portion 207 of the front 206 of the fifth part 24 extends sufficiently so as to cover a portion of the open end of the second part 18. To hold the fifth part 24 securely against the first part 16, the tab 210 on the right flap 208 is inserted into the slot 116 on the right side 106 of the first part, the tab 214 on the top flap 212 is inserted into the slot 114 on the top 104 of the first part and the tab 218 on the bottom flap 216 is inserted into the slot 108 on the bottom 100 of the first part in the manner heretofore described.

In like manner, the sixth part 26 is affixed over the open end of the fourth part 22. The sixth part 26 includes a substantially vertically oriented front face 220, a top flap 222 with a tab 224, a left flap 226 with a tab 228 and a bottom flap 230 with a tab 232. As mentioned, the front surface 220 covers the open end of the fourth part 22 and the right side 234 of the front face 220 extends sufficiently so as to cover a portion of the open end of the third part 20. The top flap 222 extends over a portion of the top 178 of the fourth part, the left flap 226 extends over a portion of the left side 182 of the fourth part an the bottom flap 230 extends over a portion of the bottom 186 of the fourth part. To connect the sixth part 26 to the fourth part 22, the tab 224 on the top flap 222 is inserted into the slot 180 on the top 178 of the fourth part, the tab 228 on the left flap 226 is inserted into the slot 184 on the left side 182 of the fourth part and the tab 232 on the bottom flap 230 is inserted into the slot 188 on the bottom 186 of the fourth part in the manner heretofore described.

In like manner, the seventh part 28 covers the remaining portions of the open ends of the second and third parts 18 and 20. The seventh part 28 includes a substantially vertically oriented right front face 236, a substantially vertically oriented left front face 238, a top right flap 240 with a tab 242, a top left flap 244 with a tab 246, a bottom left flap 248 with a tab 250 and a bottom right flap 252 with a tab 254. In position, the rightmost portion 256 of the right front face 236 partially overlaps the leftmost portion 207 of the front face 206 of the fifth part 24 and the leftmost portion 258 of the left front face 238 partially overlaps the rightmost portion 234 of the front face 220 of the sixth part 26. The top flaps 240 and 244 partially overly respectively the top 138 of the second part 18 and the top 154 of the third part 20; and, the bottom flaps 252 and 248 respectively overly the bottom 128 of the second part 18 and the bottom 164 of the third part 20. To affix the seventh part 28 to the second and third parts 18 and 20, the tab 242 on the right top flap 240 is inserted into the slot 140 on the top 138 of the second part, the tab 246 on the left top flap 244 is inserted into the slot 156 on the top 154 of the third part, the tab 250 on the bottom left flap 248 is inserted into the slot 66 on the bottom 164 of the third part and the tab 254 on the right bottom flap 252 is inserted into the slot 130 on the bottom 128 of the second part in the manner heretofore described.

The eighth and ninth parts 30 and 32 ar constructed in the same fashion and are connected in the same fashion respectively to the first and fourth parts 16 and 22.

The eighth part 30 includes a front face 260 with a tab 270, a right side 262 with a tab 264 and a left side 266 with a tab 268. This eighth part 30 is affixed to the outer flap 122 on the closed end of the first part 16. The tabs 264 and 268 are inserted into the respective vertically oriented slots 118 on the outer flap 122 of the first part and the tab 270 is inserted into the substantially horizontal slot 120 on the outer flap 122 of the first part in the manner heretofore described.

In a similar manner, the ninth part 32 includes a front 272 with a tab 282, a right side 274 with a tab 276 and a left side 278 with a tab 280. It is connected in like fashion to the outer flap 196 at the closed end of the fourth part 22. The tabs 276 and 280 are inserted into the respective vertically oriented slots 198 on the outer flap 196 of the fourth part and the tab 282 is inserted into the slot 200 on the outer flap 196 of the fourth part in the manner heretofore described.

In the preferred embodiment, first the first and second parts 16 and 18 are attached together, then the third part 20 is attached to the second part 18 and then the fourth part 22 is connected to the third part 20. Then, the fifth and sixth parts 24 and 26 are respectively connected to the first part 16 and the fourth part 22. The seventh part 28 is then affixed to the second and third parts 18 and 20. As a last step, the eighth and ninth parts 30 and 32 are affixed respectively to the first and fourth parts 16 and 22.

To facilitate this assembly of the portable automobile snowplow, it may be desirable to include appropriate openings (not shown in the drawings) in the various parts. In this way, access can be had to the inside of the parts, so as to facilitate unfolding of the tabs in order to permit disassembly of the unit.

By such assembly, a completed plow, as shown in FIGS. 1 and 2, is created. After affixation to the front of the automobile, the car may be used as necessary to plow the necessary area.

When the materials become wet and unusable, they can be easily discarded and replacements obtained. Generally, if care is used, a plow of this construction can be used from three to five times before discarding. Use of water proofing on the material will increase the useful life of the plow.

Generally speaking, the final assembly of the portable snow plow should be somewhat wider than the automobile, extend sufficiently far forward to prevent rollover, have a rear height sufficient to reach the car bumper to provide thrust, have rear side shapes protruding closely under the car bumper to prevent tilt, and have a rear shape conforming adequately to the convex lateral curvature of the typical front bumper to preclude yaw and to provide uniformity of thrust.

In the preferred embodiment, the interior dimensions of the first and third parts' cross sections would be $17\frac{3}{4}$ inches square and the cardboard thickness would be $\frac{1}{8}$ of an inch. The horizontal distance from the front bumper to the front lowest point of the plow would be 40 inches. The angle of the sides would be 33° and the backward protrusion of the sides of the first and fourth parts would be 1 inch. There would be a clearance of 1/12 of an inch between the inner surfaces of the first and third parts and the outer surfaces of the second and fourth parts within the package.

The resulting snow plow from such materials would have a width of about 71 inches and would fit in a package approximately 47 inches by 18 inches by 18 inches. This should generally be small enough to conveniently fit in the trunk of most automobiles.

It should also be appreciated that in some versions, it may be more suitable to interconnect the parts by means of tape or other fasteners. Alternate materials may be used for some parts, such as foam plastic or inflatable plastic.

I claim:

1. A portable automobile snow plow comprising:

a first part having a bottom with a slot, a left side with tabs, a top with a slot, a right side with a slot, a first outer flap with slots, a second outer flap and two inner flaps and wherein said first part is folded into a box-like structure with said outer and inner flaps defining a closed end and said box-like structure having an open end;

a second part having a bottom with a slot, a left side with slots, a top with a slot, a right side with slots into which said tabs o said left side of said first part communicate, and inner and outer flaps, wherein said second part is folded into a box-like structure with said inner and outer flaps defining a closed end and said box having an open end;

a third part having a top with a slot, a left side with tabs, a bottom with a slot, a right side with tabs which communicate with said slots in said left side of said second part, and inner and outer flaps, wherein said third part is folded into a substantially box-like structure with said inner and outer flaps defining a closed end and said box-like structure having an open end;

a fourth part having a top with a slot, a left side with a slot, a bottom with a slot, a right side with slots communicating with said tabs on said left side of said third part, a first outer flap having slots, a second outer flap and inner flaps, wherein said fourth part is folded into a substantially box-like structure and said inner and outer flaps defining a closed end of said box-like structure and said box-like structure having an open end;

a fifth part having a front face overlying said open end of said first part and having a right side overlying a portion of said right side of said first part and said right side of said fifth part having a tab that communicates with said slot on said right side of said first part, a top part of said fifth part overlying a portion of said top of said first part and said top of said fifth part having a tab that communicates with said slot in said top portion of said first part, and a bottom of said fifth part partially overlying a portion of said bottom of said first part and said bottom of said fifth part having a tab that communicates with said slot on said bottom of said first part;

a sixth part having a front face that overlies said open end of said fourth part, a top of said sixth part partially overlying said top of said fourth part and said top of said sixth part having a tab that communicates with said slot in said top of said fourth part, a left side of said sixth part partially overlying said left side of said fourth part and said left side of said sixth part having a tab that communicates with said slot in said left side of said fourth part, and a bottom of said sixth part partially overlying the bottom of said fourth part and said bottom of said sixth part having a tab that communicates with said slot in said bottom of said fourth part;

a seventh part having front faces that overly said open ends of said second and third parts, a right top portion which overlies a portion of said top of said second part and said right top portion of said seventh part having a tab that communicates with said slot in said top of said second part, a left top portion of said seventh part partially overlying the top of said third part and said left top portion of said seventh part having a tab that communicates with said slot on said top of said third part, a bottom left portion of said seventh part partially overlying the bottom of said third part and said bottom left portion of said seventh part having a tab that communicates with said slot on said bottom of said third part, and a bottom right portion of said seventh part partially overlying the bottom of said second part and said bottom right portion of said seventh part having a tab that communicates with said slot on said bottom of said second part;

an eighth part having tabs that communicate with said slots on said first outer flap of said first part; and a ninth part having tabs that communicate with said slots on said first outer flap of said fourth part.

2. A portable automobile snowplow according to claim 1, wherein said second and third parts have slightly smaller cross section dimensions than said first and fourth parts, thereby permitting said second and third parts to be nested within said first and fourth parts.

3. A portable automobile snow plow comprising;

a first part having a bottom, a left side, a top and a right side;

a second part having a bottom, a left side, a top and a right side;

means for attaching said right side of said second part to said left side of said first part;

a third part having a top, a left side, a bottom and a right side;

means for attaching said right side of said third part with said left of said second part;

a fourth part having a top, a left side, a bottom and a right side;

means for attaching said right side of said fourth part to said left side of said third part;

a fifth part having a front face overlying an open end of said first part, a right side overlying a portion of said right side of said first part, a top part overlying a portion of said top of said first part, and a bottom partially overlying a portion of said bottom of said first part;

means for attaching said right side of said fifth part with said right side of said first part;

means for attaching said top part of said fifth part with said top of said first part;

means for attaching said bottom of said fifth part with said bottom of said first part;

a sixth part having a front face overlying an open end of said fourth part, a top partially overlying said top of said fourth part, a left side partially overlying said left side of said fourth part, and a bottom partially overlying the bottom of said fourth part;

means for attaching said top of said sixth part with said top of said fourth part;

means for attaching said left side of said sixth part with said left side of said fourth part; with said bottom of said fourth part;

a seventh part having front faces overlying open ends of said second and third parts, a right top portion which overlies a portion of said top of said second part, a left top portion overlying said top of said third part, a bottom left portion partially overlying said bottom of said third part, and a bottom right portion partially overlying the bottom of said second part;

means for attaching said right top portion of said seventh part with said top of said second part;

means for attaching said left top portion of said seventh part with said top of said third part;

means for attaching said bottom left portion of said seventh part with said bottom of said third part;

means for attaching said bottom right portion of said seventh part with said bottom of said second part;

an eighth part;

means for attaching said eighth part to said first part;

a ninth part; and means for attaching said ninth part to said fourth part.

4. A portable automobile snow plow according to claim 3, wherein:

said first part is folded into a box-like structure with inner and outer flaps defining a closed end and said box-like structure having said open end;

said second part is folded into a box-like structure with inner and outer flaps defining a closed end and said box-like structure having said open end;

said third part is folded into a box-like structure with inner and outer flaps defining a closed end and said box-like structure having said open end; and said fourth part being folded into a box-like structure and inner and outer flaps defining a closed end of said box-like structure and said box-like structure having said open end.

* * * * *